US012460900B1

(12) United States Patent
Lamboy et al.

(10) Patent No.: US 12,460,900 B1
(45) Date of Patent: Nov. 4, 2025

(54) ARROW STABILIZER FOR ARCHERY AIRGUNS

(71) Applicant: Umarex USA, Inc., Fort Smith, AR (US)

(72) Inventors: Stephen R. Lamboy, Fort Smith, AR (US); Kyle Bruso, Lavaca, AR (US)

(73) Assignee: Umarex USA, Inc., Fort Smith, AR (US)

( * ) Notice: Subject to any disclaimer, the term of this patent is extended or adjusted under 35 U.S.C. 154(b) by 0 days.

(21) Appl. No.: 19/216,623

(22) Filed: May 22, 2025

(51) Int. Cl.
*F41B 11/80* (2013.01)
*F41B 5/14* (2006.01)
*F41B 5/22* (2006.01)

(52) U.S. Cl.
CPC ..... *F41B 11/80* (2013.01); *F41B 5/1426* (2013.01); *F41B 5/143* (2013.01)

(58) Field of Classification Search
CPC ..... F41B 5/143; F41B 5/1426; F41B 5/12; F41B 11/62; F41B 11/723; F41B 11/83; F41B 11/80
USPC ... 124/24.1, 25, 26, 27, 44.5, 56, 73, 83, 85
See application file for complete search history.

(56) References Cited

U.S. PATENT DOCUMENTS 3,739,765 A * 6/1973 Moore ..... F41B 5/12 124/44.6
4,027,645 A * 6/1977 Damron ..... F41B 5/143 124/44.5
4,290,407 A * 9/1981 Damron ..... F41B 5/0005 124/44.5
4,291,664 A * 9/1981 Nishioka ..... F41B 5/143 124/44.5
4,890,597 A * 1/1990 Ekstrom ..... F41B 11/83 124/71
4,958,617 A * 9/1990 Anderson ..... F41B 5/143 124/44.5
5,086,749 A * 2/1992 Ekstrom ..... F41B 11/83 124/71
5,263,465 A * 11/1993 Anderson ..... F41B 5/143 124/44.5
5,460,153 A * 10/1995 Huntt ..... F41B 5/143 124/44.5
7,789,080 B2 * 9/2010 Fielding, Jr. ..... A01K 81/00 273/350
7,823,572 B2 * 11/2010 Anderson ..... F41B 5/143 124/25

(Continued)

*Primary Examiner* — Alexander R Niconovich
(74) *Attorney, Agent, or Firm* — Eric B. Fugett; Mark A. Pitchford; Pitchford Fugett, PLLC

(57) ABSTRACT

An arrow stabilizer for an archery airgun includes an elongated body configured to be secured to the airgun. The body defines a non-cylindrical passage extending longitudinally therethrough. The passage is configured to receive an arrow and support a shaft of the arrow as the arrow travels through the passage when launched by the airgun. The passage can have a non-circular cross-sectional profile that includes a central bore configured to closely receive the arrow shaft, and a plurality of radially extending slots configured to receive the fletching. The slots and central bore cooperate to form stabilizing rails upon which the arrow can ride through the passage. The rails guide the arrow shaft smoothly along the passage and hold the arrow substantially stable as it travels therethrough when launched by the archery airgun.

16 Claims, 15 Drawing Sheets

(56) References Cited

U.S. PATENT DOCUMENTS

| | | | | |
|---|---|---|---|---|
| 8,210,161 | B2 * | 7/2012 | Mattos | F41B 11/62 124/74 |
| 8,485,171 | B2 * | 7/2013 | Romney | F41B 11/54 124/65 |
| 8,978,634 | B2 * | 3/2015 | Darlington | F41B 5/143 124/25 |
| 9,546,844 | B2 * | 1/2017 | Hall | F41C 9/08 |
| 9,851,173 | B2 * | 12/2017 | Malheiros | F41B 11/62 |
| 10,921,080 | B2 * | 2/2021 | Hibbitts | F41A 21/30 |
| 11,143,482 | B2 * | 10/2021 | Egerdee | F41B 5/126 |
| 11,385,033 | B2 * | 7/2022 | Langdon | F41B 5/12 |
| 11,512,923 | B2 * | 11/2022 | Trpkovski | F41B 5/1469 |
| 11,703,303 | B1 * | 7/2023 | Bray | F41A 21/36 124/83 |
| 12,404,051 | B2 * | 9/2025 | Gautier | B64U 70/50 |
| 2005/0188979 | A1 * | 9/2005 | Berry | F42B 14/064 124/76 |
| 2016/0290757 | A1 * | 10/2016 | Khoshnood | F41B 5/123 |
| 2022/0397362 | A1 * | 12/2022 | DeJessa | F41A 21/30 |
| 2023/0012976 | A1 * | 1/2023 | Blosser | F41B 5/123 |

* cited by examiner

ARROW STABILIZER FOR ARCHERY AIRGUNS

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

Not Applicable.

STATEMENT REGARDING FEDERALLY SPONSORED RESEARCH OR DEVELOPMENT

Not Applicable.

REFERENCE TO SEQUENCE LISTING OR COMPUTER PROGRAM LISTING APPENDIX

Not Applicable.

BACKGROUND OF THE INVENTION

The present invention relates generally to the field of archery, and more particularly, to pneumatic arrow guns (i.e., archery airguns).

Air archery is a rapidly growing shooting discipline that involves the use of a compressed gas-powered gun to propel or launch a specialized arrow or bolt toward a target. The arrows used in most archery airguns differ from traditional arrows in that the arrow shafts typically lack nocks and instead have either (i) a hollow shaft with an open rear end designed to slide over a metal tube (i.e., a stem) in the barrel or handguard of the airgun like a sleeve, or (ii) a solid rear end fitted with a sealing member (e.g., a rubber O-ring) designed to seal the bore of an airgun barrel at the rear end of the arrow so the arrow can be propelled like a pellet via the direct application of compressed air. Compressed gas supplied to the arrow-whether via a stem to the interior of the arrow or directly to the rear of the arrow-propels the arrow forward through the barrel or handguard of the airgun and toward the target.

However, the accuracy of currently available archery airguns equipped with stem-driven propulsion systems is inconsistent due at least in part to the fact that the stems of such weapons are arranged to float unsupported inside the barrel or handguard. This causes the stems to vibrate during launch of (i.e., firing) an arrow, which in turn causes the arrow to wobble or flex as it moves forward through the barrel or handguard and ultimately toward a target. Similarly, arrows launched by weapons that rely on the direct application of compressed air to the rear of the arrow to propel the arrow through a barrel tend to also wobble as the fletching of the arrow can get twisted inside and drag against the bore of the barrel as the arrow travels through the barrel and toward the target. Available arrow support systems are do not remedy these problems as they typically only support the arrow at the front of the shaft using a specialized collar and at the rear of the shaft where the fletching or a sealing member contacts an interior surface of the barrel.

Accordingly, what is needed are improvements in archery airguns.

BRIEF SUMMARY

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. Features of the presently disclosed invention overcome or minimize some or all of the identified deficiencies of the prior art, as will become evident to those of ordinary skill in the art after a study of the information presented in this document.

It is an object of the present invention to provide arrow supports and stabilizing devices for archery airguns, including barrels and barrel cores, that are fixed to the archery airgun and do not move with the arrow during launch or firing. The novel arrow stabilizers disclosed herein include an elongated body that defines a unique arrow bore or passage that is shaped and sized to match a transverse profile or silhouette of an arrow, including the shaft and fletching. The passage is designed to closely receive, radially capture, and stably guide or support the arrow as it travels through the passage when launched by the archery airgun. This greatly reduces vibration and lateral movement of the arrow during travel, which in turn coordinately increases arrow flight consistency and accuracy. Arrow stabilizers, barrel cores, and barrels disclosed herein are also designed to attenuate the perceived audible report emitted by the archery airgun upon firing.

Numerous other objects, advantages and features of the present disclosure will be readily apparent to those of skill in the art upon a review of the following drawings and description of exemplary embodiments.

BRIEF DESCRIPTION OF THE SEVERAL VIEWS OF THE DRAWINGS

Non-limiting and non-exhaustive embodiments are described with reference to the following figures, wherein like reference numerals refer to like parts throughout the various drawings unless otherwise specified. In the drawings, not all reference numbers are included in each drawing, for the sake of clarity.

DETAILED DESCRIPTION

The details of one or more embodiments of the present invention are set forth in this document. Modifications to embodiments described in this document, and other embodiments, will be evident to those of ordinary skill in the art after a study of the information provided herein. The information provided in this document, and particularly the specific details of the described exemplary embodiment(s), is provided primarily for clearness of understanding and no unnecessary limitations are to be understood therefrom. In case of conflict, the specification of this document, including definitions, will control.

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

While the terms used herein are believed to be well understood by one of ordinary skill in the art, a number of terms are defined below to facilitate the understanding of the embodiments described herein. Unless defined otherwise, all technical and scientific terms used herein have the same meaning as commonly understood by one of ordinary skill in the art to which the subject matter disclosed herein belongs. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

Figure 1:
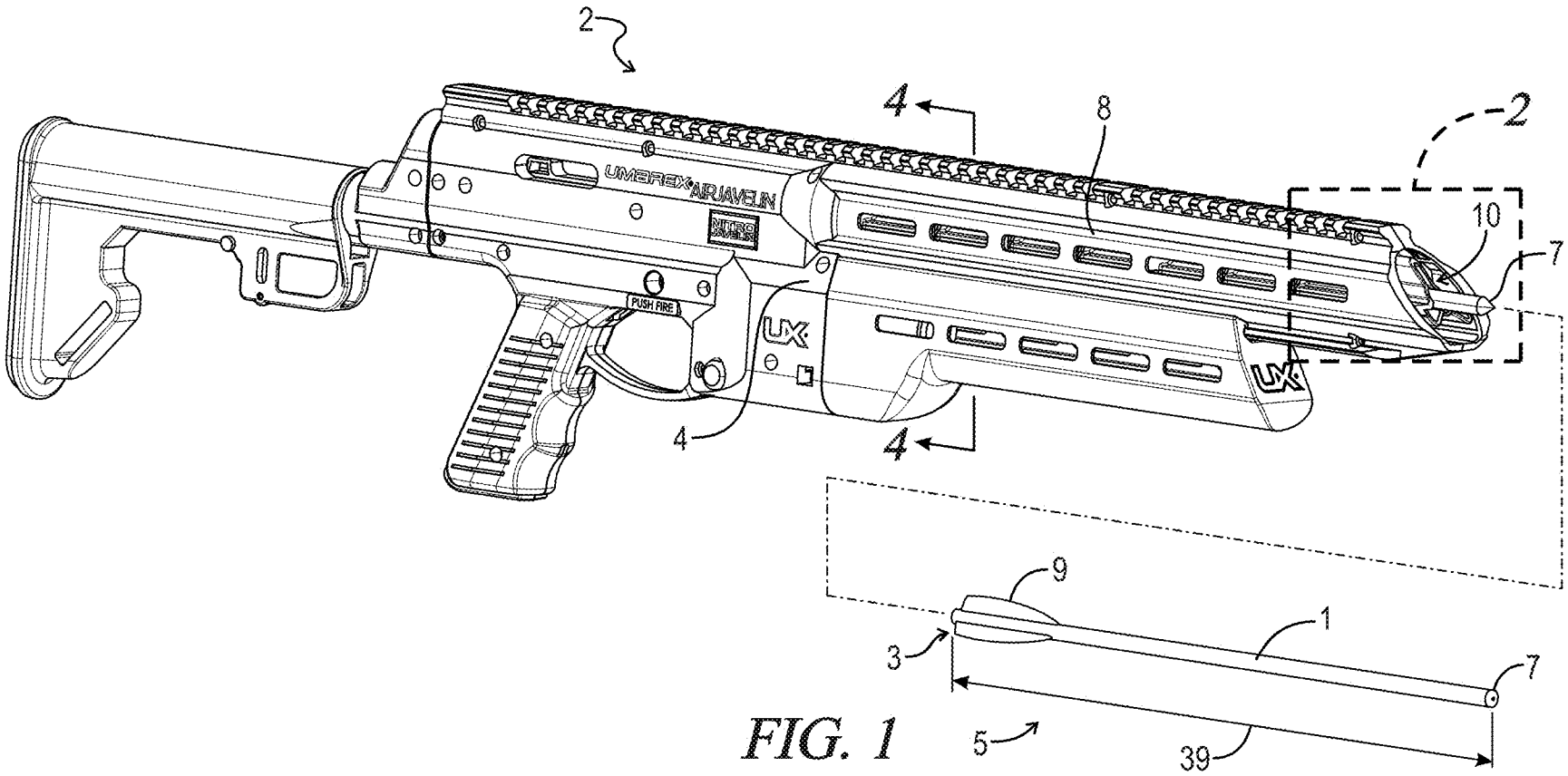
FIG. 1 is a perspective view of an embodiment of an archery airgun equipped with an arrow stabilizer constructed in accordance with an embodiment of the present invention. The archery airgun is depicted loaded with a first arrow. An identical second arrow is depicted below the archery airgun in same the longitudinal positioned relative to the airgun as the first arrow with a dashed indicator illustrating the direction in which arrows are loaded into the archery airgun.

As described herein, an "upright" position is considered to be the position of apparatus components while in proper operation or in a natural resting position as described and shown herein, for example, in FIG. 1. The upright firing position of a firearm is a generally level firing position. "Vertical," "horizontal," "above," "below," "side," "top," "bottom," "upper," "lower," and other orientation terms are described with respect to this upright position during operation, unless otherwise specified, and are used to provide an orientation of embodiments of the invention to allow for proper description of example embodiments. A person of skill in the art will recognize, however, that the apparatus can assume different orientations when in use.

As used herein, the terms "front" and "forward" means in a direction extending toward the muzzle of the airgun. In some cases, the term "forward" can also mean forward beyond the muzzle of the airgun. The terms "aft" and "rear" means in a direction extending away from the muzzle of the airgun toward a rear end of a airgun. In some cases, the term "rearward" can also mean rearward beyond the rear end of the airgun.

The term "when" is used to specify orientation for relative positions of components, not as a temporal limitation of the claims or apparatus described and claimed herein unless otherwise specified.

The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments.

All measurements should be understood as being modified by the term "about" regardless of whether the word "about" precedes a given measurement.

The terms "significantly", "substantially", "approximately", "about", "relatively," or other such similar terms that may be used throughout this disclosure, including the claims, are used to describe and account for small fluctuations, such as due to variations in manufacturing or processing from a reference or parameter. Such small fluctuations include a zero fluctuation from the reference or parameter as well. For example, they can refer to less than or equal to +10%, such as less than or equal to +5%, such as less than or equal to +2%, such as less than or equal to +1%, such as less than or equal to +0.5%, such as less than or equal to +0.2%, such as less than or equal to +0.1%, such as less than or equal to +0.05%. In some contexts, and unless otherwise specifically defined hereinafter, the term "substantially" means what is considered normal or possible within the limits of applicable industry-accepted manufacturing practices and tolerances.

The term "arrow" as used herein means refers to fin-stabilized projectiles adapted to be launched by archery bows and archery airguns. The term "arrow" as used herein specifically includes, but is not limited to, bolts and other fin-stabilized projectiles designed to be propelled by stem-based compressed gas propulsion systems.

All references to singular characteristics or limitations of the present disclosure shall include the corresponding plural characteristic(s) or limitation(s) and vice versa, unless otherwise specified or clearly implied to the contrary by the context in which the reference is made.

All combinations of method or process steps as used herein can be performed in any order, unless otherwise specified or clearly implied to the contrary by the context in which the referenced combination is made.

The methods and devices disclosed herein, including components thereof, can comprise, consist of, or consist essentially of the essential elements and limitations of the embodiments described herein, as well as any additional or optional components or limitations described herein or otherwise useful.

Referring initially to FIGS. 1-5, there is shown an embodiment of an example archery airgun 2 equipped with an arrow stabilizer 10 constructed in accordance with an embodiment of the present invention. The depicted archery airgun 2 includes a handgrip, a buttstock, a receiver 4, an air stem 6, and a handguard 8. The receiver 4 houses a portion of the propulsion system. The stem 6 protrudes from the receiver into the handguard 8. A hollow arrow 5 is received or mounted on the stem 6 inside the handguard 8. The arrow 5 includes a hollow shaft 1, fletching 3, and a tip or point 7. The fletching 3 includes three fletches 9, also commonly referred to as fins or vanes 9. In other embodiments, the fletching 3 can include a different number of fletches. When the airgun 2 is loaded with an arrow 5 and fired, compressed gas is supplied by the propulsion system to the stem 6 inside the handguard 8 in order to launch the arrow 5 off of the stem 6 and toward a target at high speed. It is to be understood that the arrow stabilizer 10 disclosed herein is equally suited for use with stemless archery airguns that supply compressed gas directly to the rear of an arrow fitted with a sealing member in order to propel the arrow through a barrel. For the avoidance of doubt, all embodiments of the arrow stabilizer disclosed herein are broadly usable with all known types of archery airguns and archery airgun propulsion systems. As such, no limitation is meant on the scope of the invention except as set forth in the appended claims.

Referring additionally to FIGS. 7-12, the arrow stabilizer 10 is secured to the receiver 4 of the airgun 2 and is housed inside the handguard 8. In some embodiments, the arrow stabilizer 10 can also or alternatively be secured to the handguard 8. The arrow stabilizer 10 is an elongated body 12. The elongated body 12 can serve as a barrel or a barrel core for an archery airgun. The elongated body 12 has a front end 14 and a rear end 16. The rear end 16 is configured to be secured to the receiver 4 of the archery airgun 2. The elongated body 12 defines a longitudinal axis 18 and a passage 20. The passage 20 extends longitudinally along the axis 18 through the elongated body 12 from the front end 14 to the rear end 16. An arrow 5 launched by the archery airgun 2 exits the passage 20 through the front end 14. The passage 20 is uniquely shaped and sized to receive the arrow 5 (including fletching 3) and support the arrow shaft 1 as the arrow 5 travels through the passage 20 when launched by the archery airgun 2. Unlike the barrel bore of traditional archery airguns, the passage 20 of the novel arrow stabilizer 10 disclosed herein is non-cylindrical.

Figure 4:
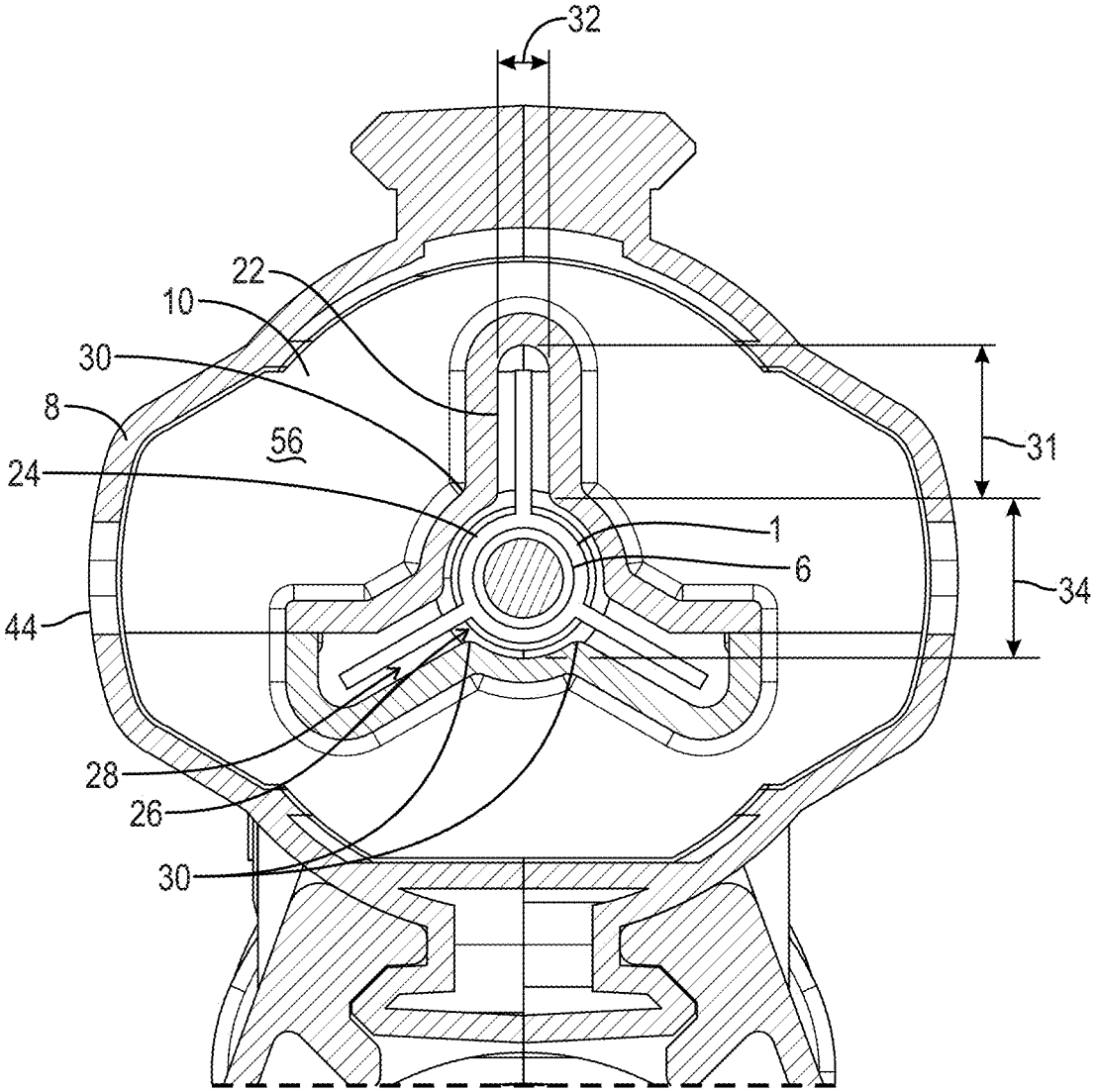
FIG. 4 is fragmentary sectional view of the objects of FIG. 1 taken along line 4-4.

Specifically, the exemplar passage 20 as depicted in the figures has a non-circular cross-sectional profile 22, as best shown in FIG. 4. The cross-sectional profile 22 of the passage 20 is shaped and sized to provide sufficient clearance that the arrow 5, including the fletching 3 and the shaft 1, can freely move forward and rearward inside the passage 20, for example, when being launched and loaded, respectively. The non-circular cross-sectional profile 22 of the passage 20 corresponds to a transverse profile or silhouette 24 of the arrow 5 taken across the widest portion of the fletching 3, as shown in FIGS. 1 and 4. The non-circular cross-sectional profile 22 includes a central bore 26 and a plurality of slots 28. The slots 28 extend radially outward (i.e., away from) the central bore 26. The bore 26 extends longitudinally along the axis 18 through the elongated body 12 from the front end 14 to the rear end 16. The slots 28 also extend longitudinally along the bore 26 through the elongated body 12 from the front end 14 to the rear end 16. The slots 28 are in fluid communication with the central bore 26. The central bore 26 is shaped and sized to closely receive the shaft 1 of the arrow 5. As such, the central bore 26 can be generally cylindrical as shown, but need not be perfectly cylindrical. The slots 28 are shaped and sized to closely receive the fins or vanes 9 (i.e., the fletching) of the arrow 5. Each slot 28 is configured to receive a respective fin or vane 9 of the arrow 5. Each slot 28 has a width 32 that is less than a diameter 34 of the bore 26. This prevents the arrow 5 from spinning in the passage 20. The depth 31 of each slot 28 (measured from the bore 26) is greater than the height 11 of each fin or vane 9. This prevents the fletching 9 from becoming bent or otherwise deformed while the arrow 5 is in the passage 20 and subsequently not flying true after launch.

Figure 3:
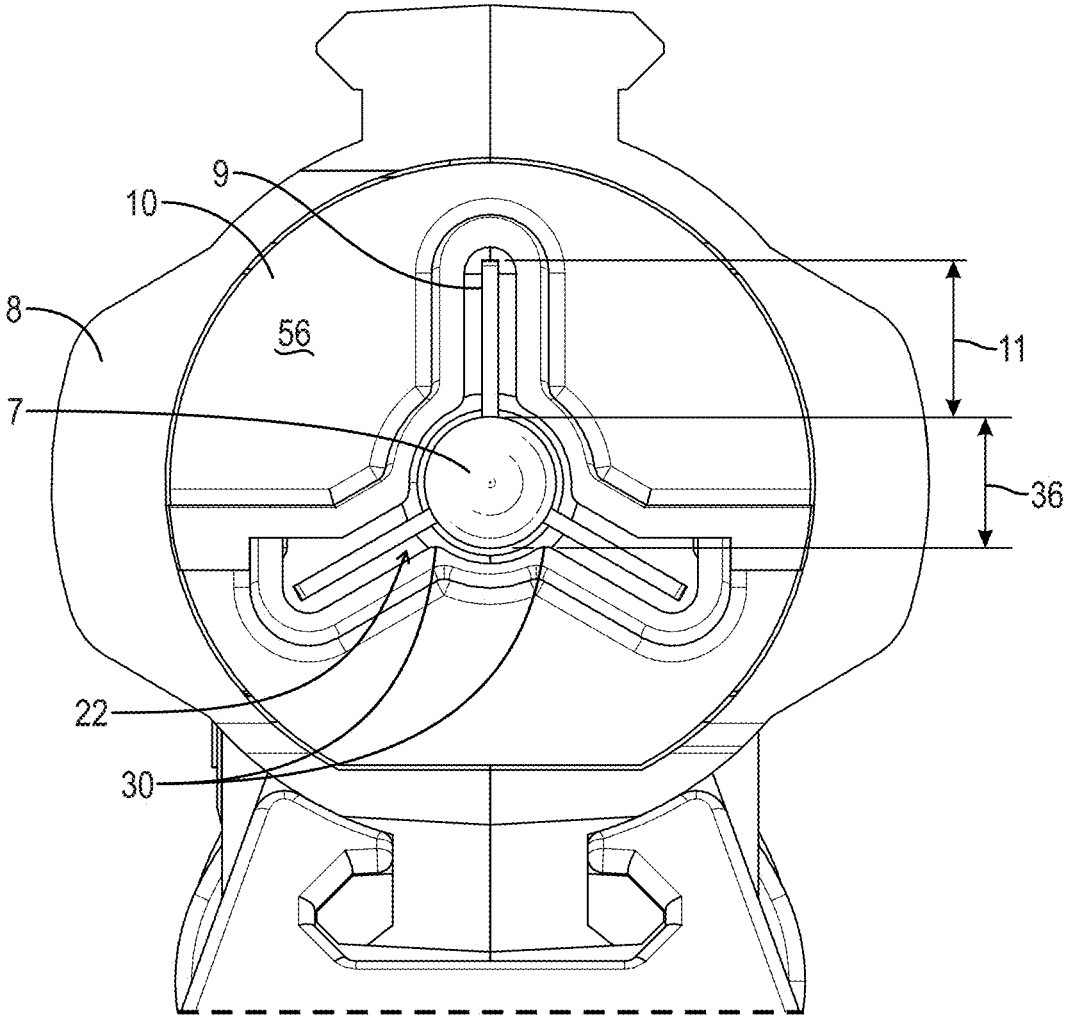
FIG. 3 is fragmentary front elevational view of the objects of FIG. 2.

The negative space of the slots 28 cooperate with that of the central bore 26 to form shoulders or rails 30. The rails 30 are spaced around the circumference of the central bore 26, as shown in FIGS. 3-4. The rails 30 extend the length of the passage 20 along the intersections of the central bore 26 and the slots 28. The arrow 5 rides on the rails 30 and the interior surface 27 of the central bore 26 through the passage 20 when the arrow 5 is launched by the archery airgun 2. In addition, the width 32 of each slot 28 is less than a diameter 36 of the arrow shaft 1 in order to prevent the arrow shaft 1 from moving into and becoming lodged in a slot 28 during travel through the passage 20. The placement of the fletching 3 in the slots 28 maintains the arrow shaft 1 in a central position on the interior surface 27 of the central bore 26 between two adjacent rails 30 as the arrow 5 travels through the passage 20 by helping deter the arrow 5 from moving laterally back and forth as it moves forward through the passage 20. These features help minimize any lateral movement of the arrow 5 inside the passage 20 and thereby stabilize the arrow 5 by guiding the shaft 1 smoothly along the central bore 26 as the arrow 5 travels through the passage 20 when launched by the airgun 2. As a result, the arrow stabilizer 10 of the present invention holds the arrow 5 considerably more stable as it travels through the passage 20 upon firing than any known archery airgun. This in turns vastly improves arrow flight consistency and accuracy. In some embodiments, the arrow stabilizer 10 holds the arrow 5 substantially stable as it travels through the passage 20 when launched by the airgun 2.

As used herein, "substantially stable" means the arrow shaft 1 moves perpendicular to the longitudinal axis 18 (i.e., laterally) by less than half the diameter 36 of the arrow shaft 1 as the arrow 5 moves along the passage 20. In some embodiments, "substantially stable" can mean the arrow shaft 1 moves laterally by less than about 30%, 25%, 20%, 15%, 10% or 5% of the diameter 36 of the arrow shaft 1 as the arrow 5 moves along the passage 20.

It is to be understood that although the arrow 5 loaded in the archery airgun 2 is depicted in the figures as spaced from (i.e., floating above) the rails 30 and the interior surface 27 of the bore 26 (see, e.g., FIGS. 3-4), this is because the arrow 5 is mounted on and supported by the stem 6 and therefore spaced by the stem 6 from (i.e., above) the rails 30 and the interior surface 27 of the central bore 26 inside the elongated body 12. In use, the force applied to the arrow 5 upon firing by the sudden release of compressed gas to propel the arrow 5 can cause the shaft 1 to contact an upper portion of the interior surface 27 of the central bore 26 before gravity pulls the arrow back downward into contact with the lower interior surface of the bore 26. In order to give the arrow 5 enough runway to optimally stabilize inside the passage 20, the passage 20 can be more than half as long as the arrow 5. Put another way, the passage 20 can have a length 38 that is greater than half a length 39 of the arrow 5.

Archery airguns, like all airguns and firearms, emit an audible report upon firing as the high-pressure gas propelling the arrow exits the muzzle of the weapon behind the arrow. In some cases, this report can be significant, which is especially undesirable while hunting. Consequently, embodiments of the arrow stabilizer 10 disclosed herein are advantageously provided with integral suppression features. More specifically, in some embodiments, the elongated body 12 can include a plurality of apertures 40 configured to attenuate a sound of the arrow 5 exiting the passage 20 when the arrow 5 is launched or fired by an airgun. The apertures 40 extend through the elongated body 12 from the passage 20 to an exterior surface 42 of the elongated body 12. The apertures 40 can have any suitable shaped, including but not limited to linear slots 40, circular holes, arcuate channels, and helical grooves. Each aperture 40 is in fluid communication with the central bore 26. In some embodiments, each aperture 40 can also or alternatively be in fluid communication with one of the radially extending slots 28. The apertures 40 are designed to bleed off or vent the high-pressure gas propelling the arrow 5 through the passage 20 before the entire volume of such gas reaches the terminal front end 14 or muzzle of the elongated body 12. For maximum sound attenuation without loss of arrow velocity, the apertures 40 are defined through a portion of the elongated body 12 proximate to the front end 14 thereof.

Figure 2:
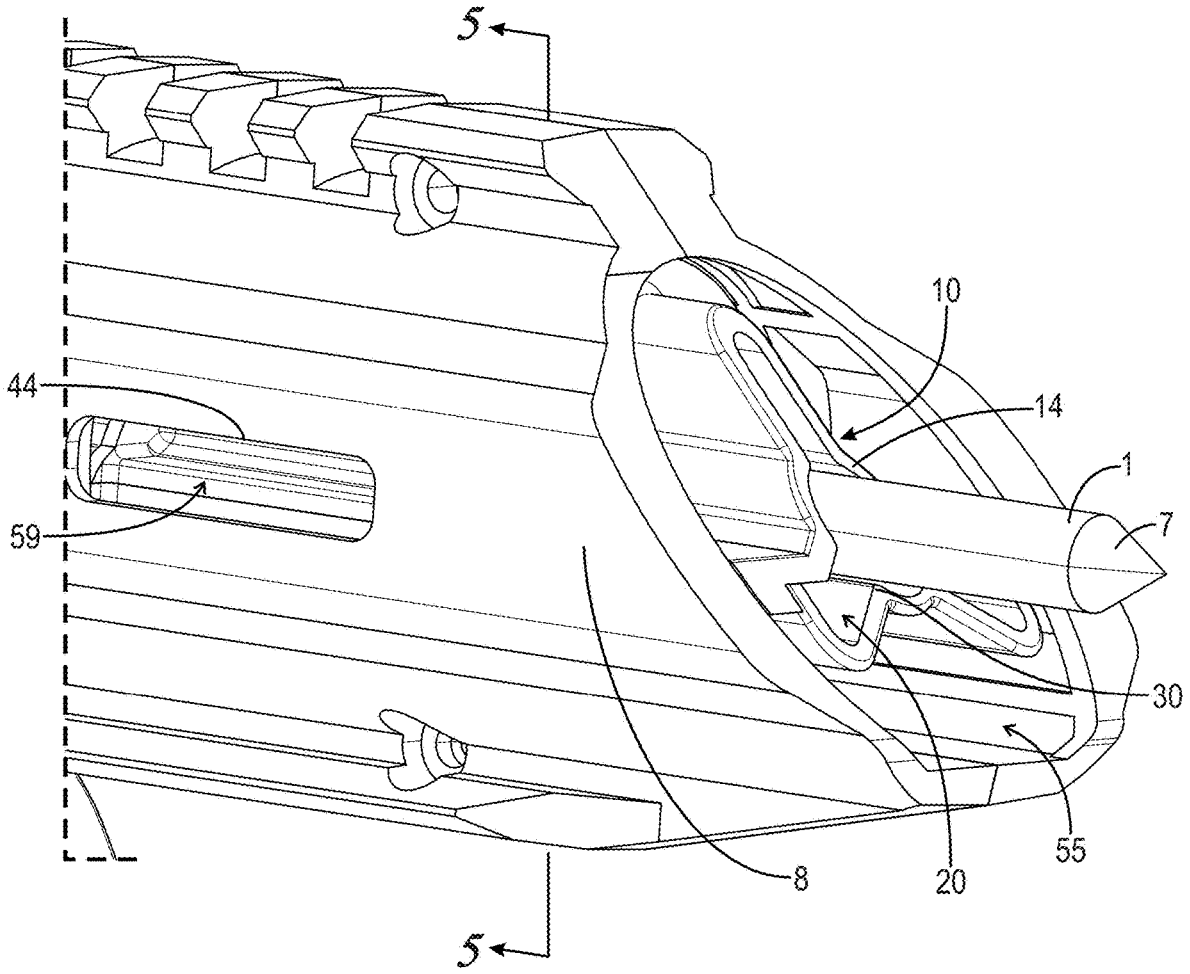
FIG. 2 is a magnified detail view of the objects of FIG. 1 at location 2.
Figure 5:
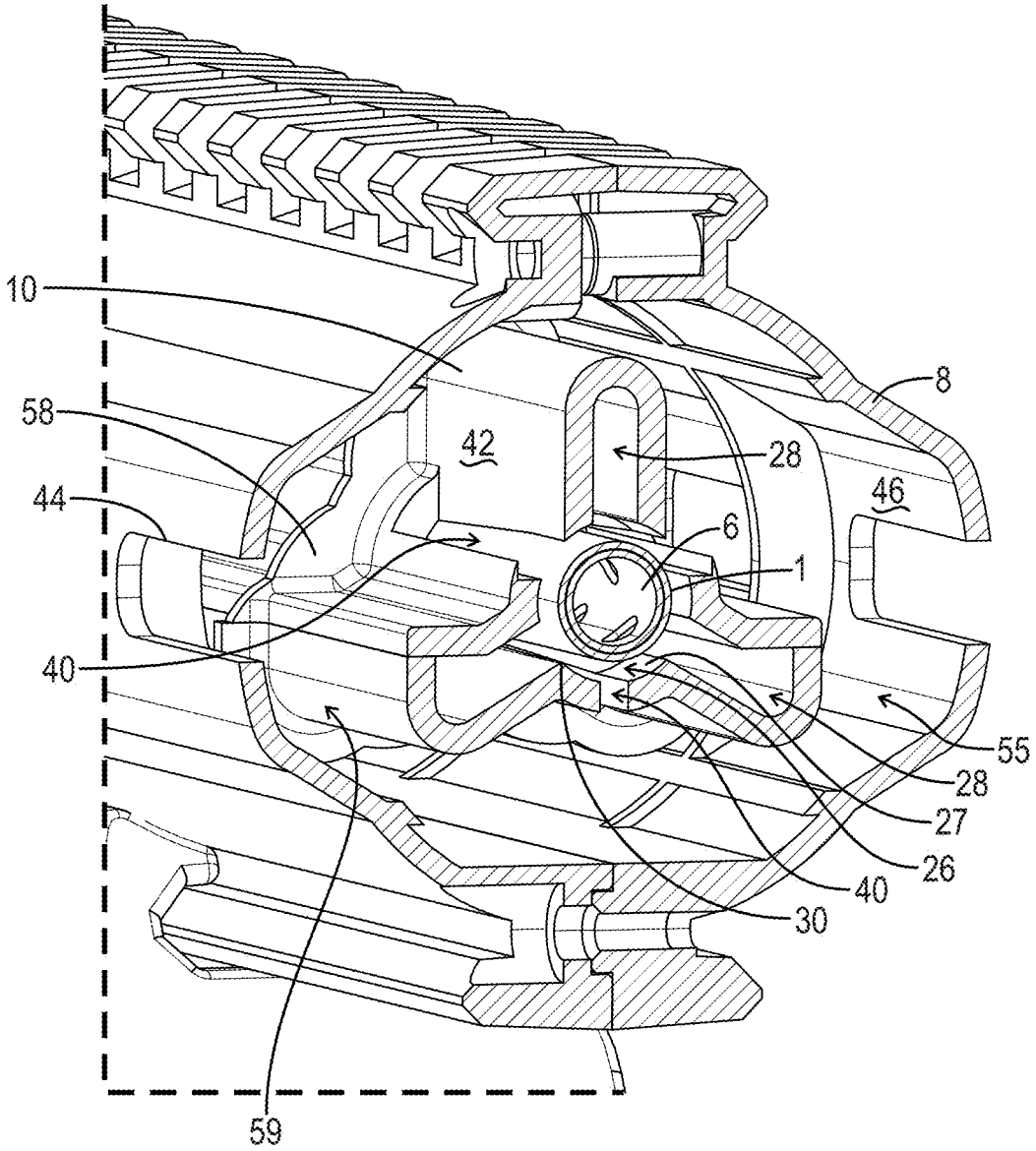
FIG. 5 is a perspective sectional view of the objects of FIG. 2 taken along line 5-5.

As shown in FIGS. 1-2 and 5, embodiments of an arrow stabilizer 10 with sound attenuation features can be housed in a handguard 8. The handguard 8 can have a plurality of accessory mounting apertures, such as M-LOK slots 44, defined in the sidewalls thereof. In other embodiments, an arrow stabilizer 10 with sound attenuating apertures 40 can be housed in a handguard having solid sidewalls and no accessory mounting apertures (not shown). In still other embodiments, an arrow stabilizer 10 with (or without) sound attenuation features can be housed in a tubular barrel shroud 52 to form a barrel 50 for an archery airgun that resembles a traditional firearm barrel, as exemplified in FIG. 6. In all such embodiments, the barrel shroud 52 or handguard 8 can define an interior space 55 around the elongated body 12 into which compressed gas emitted by the airgun during launch of the arrow 5 can vent through the sound attenuation apertures 40 as the arrow 5 exits the passage 20 to attenuate the report emitted upon firing.

In addition, whether the elongated body 12 is housed inside a handguard 8 or a barrel shroud 52, the elongated body 12 can be provided with a plurality of baffles 54 spaced along the length thereof from the front end 14 to the rear end 14. The baffles 54 can be positioned in the interior space 55 between the external surface 42 of the elongated body 12 and an interior surface 46, 48 of the handguard 8 or barrel shroud 52, respectively, in which the body 12 is housed. The baffles 54 can be arranged to help maintain the rigidity of the elongated body 12 by spacing it from the interior surface 46, 48 of the handguard 8 or barrel shroud 52. The baffles 54 can also be strategically spaced along the elongated body 12 so as to slow or circulate compressed gas vented from the passage 20 into the interior space 55 through the plurality of sound attenuation apertures 40, to thereby further reduce the audible report emitted by the archery airgun upon firing.

In some embodiments, the plurality of baffles 54 can include baffles of different sizes. For example, as shown in FIGS. 7-12, the plurality of baffles 54 can include larger structural baffles 56 and smaller sound attenuating baffles 58. The structural baffles 56 can be sized and shaped to connect the elongated body 12 to the interior surface 46, 48 of the handguard 8 or barrel shroud 52 and maintain the rigidity and spacing of the elongated body 12 therein. As such, the structural baffles 56 can function as flanges 56 on the exterior surface 42 of the elongated body 12 that serve to compartmentalize the interior space 55 and space the elongated body 12 from the interior surface 46, 48 of the handguard 8 or barrel shroud 52. The sound attenuating baffles 58 can be sized and shaped to slow or circulate compressed gas vented from the passage 20 into the interior space 55 through the plurality of sound attenuation apertures 40. In the depicted embodiment, a structural baffle 56 at the front end 14 of the elongated body 12 and another structural baffle 56 spaced rearwardly from the sound attenuation apertures 40 can be separated by multiple sound attenuating baffles 58. The two structural baffles 56 can be coupled to the interior surface 46, 48 of the handguard 8 or barrel shroud 52 so as to define a compartment 59 between them into which compressed gas can vent from the sound attenuation apertures 40. The compartment 59 can be sealed or not.

Figure 6:
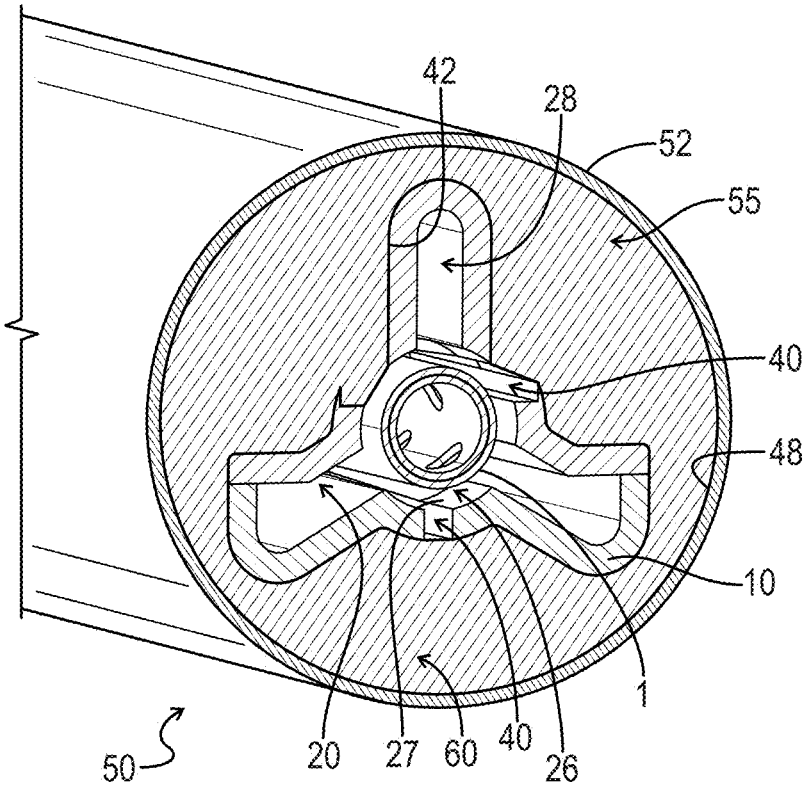
FIG. 6 is a perspective sectional view of an embodiment of a barrel for an archery airgun constructed in accordance with an embodiment of the present invention and equipped with the arrow stabilizer of FIG. 1.
Figure 7:
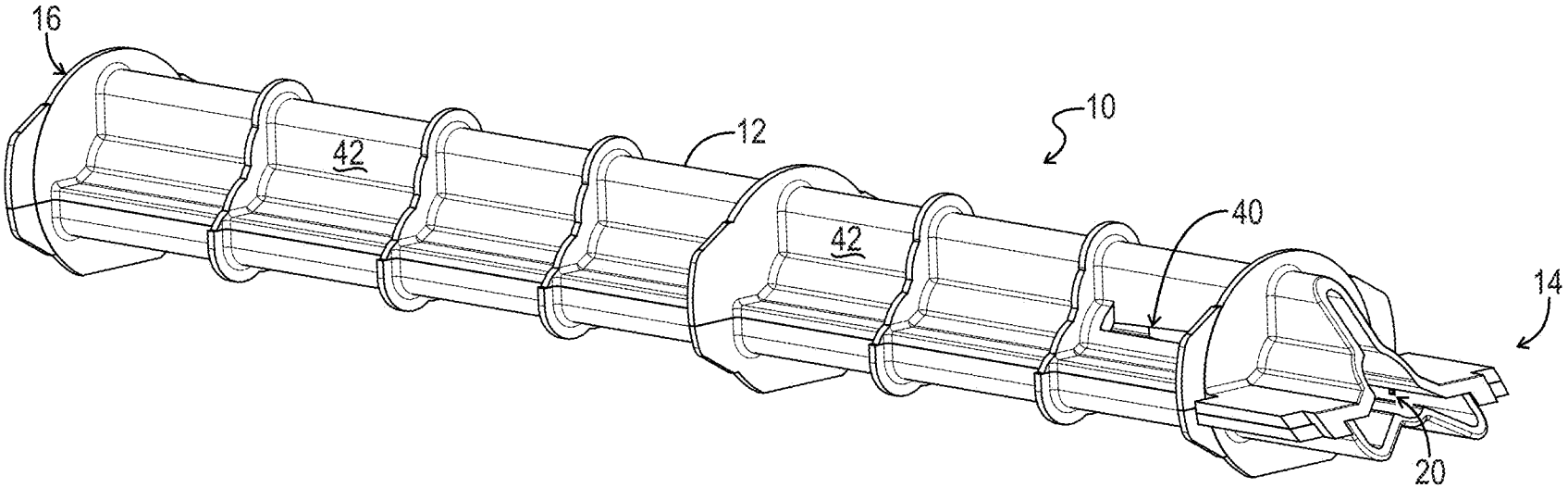
FIG. 7 is an elevated front right side perspective view of the arrow stabilizer of FIG. 1 in isolation.
Figure 8:
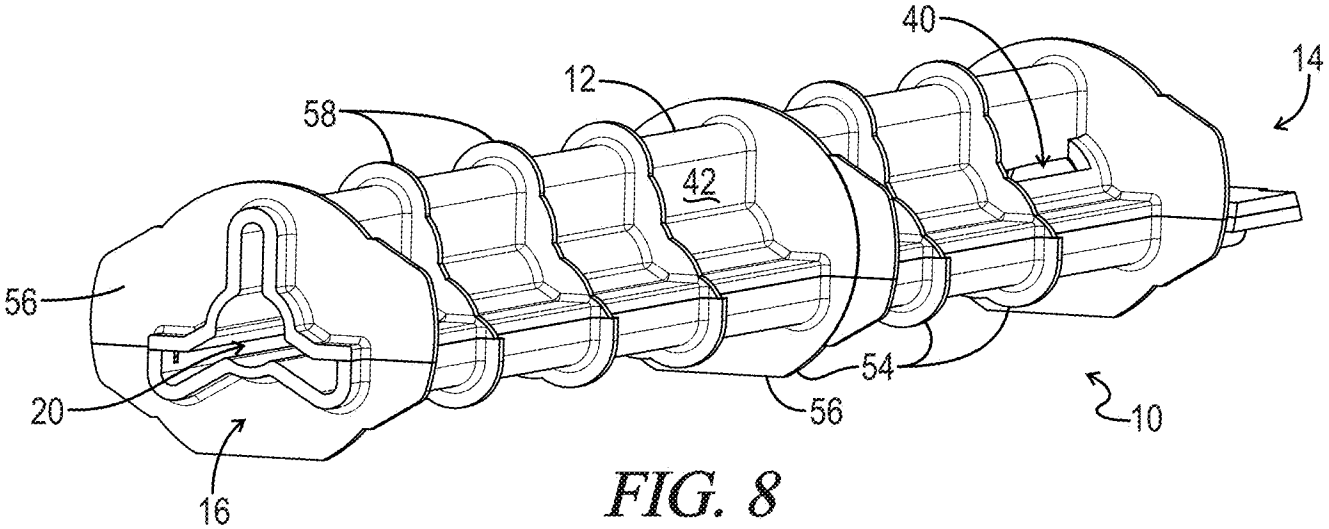
FIG. 8 is an elevated rear right side perspective view of the archery airgun of claim 7.
Figure 9:
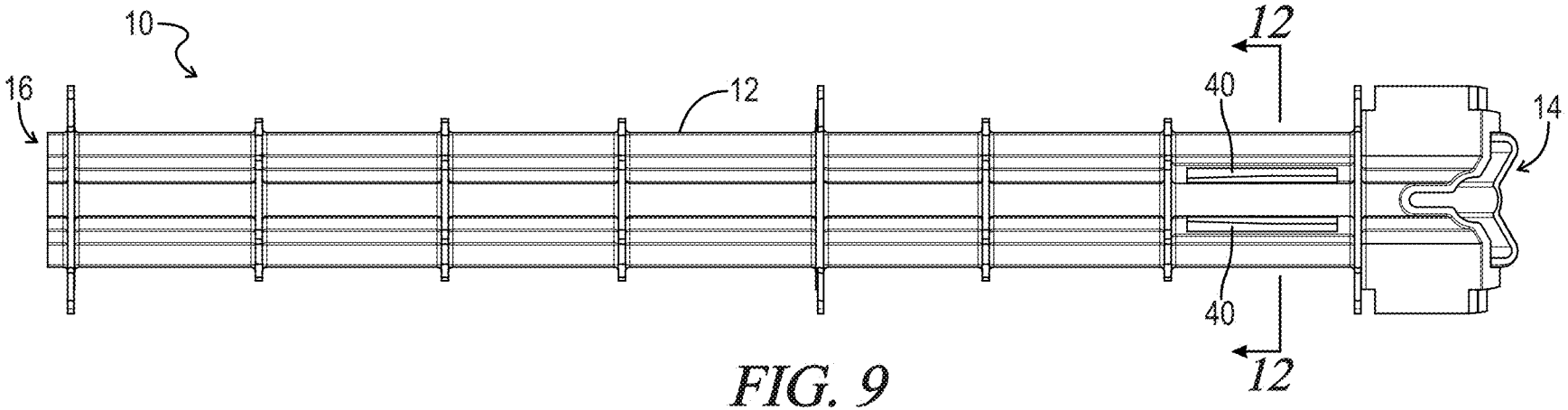
FIG. 9 is a top plan view of the archery airgun of claim 7.
Figure 10:
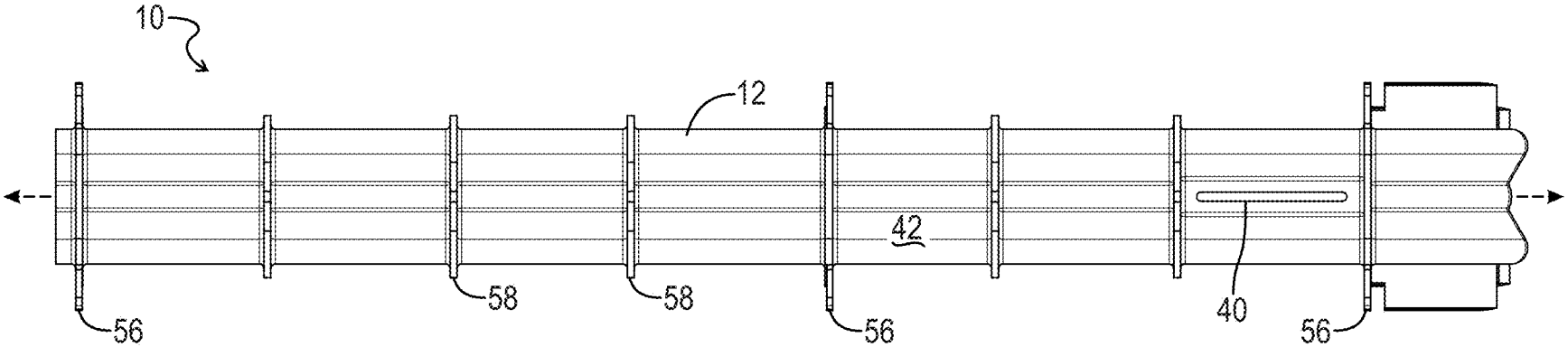
FIG. 10 is a bottom plan view of the archery airgun of claim 7.
Figure 11:
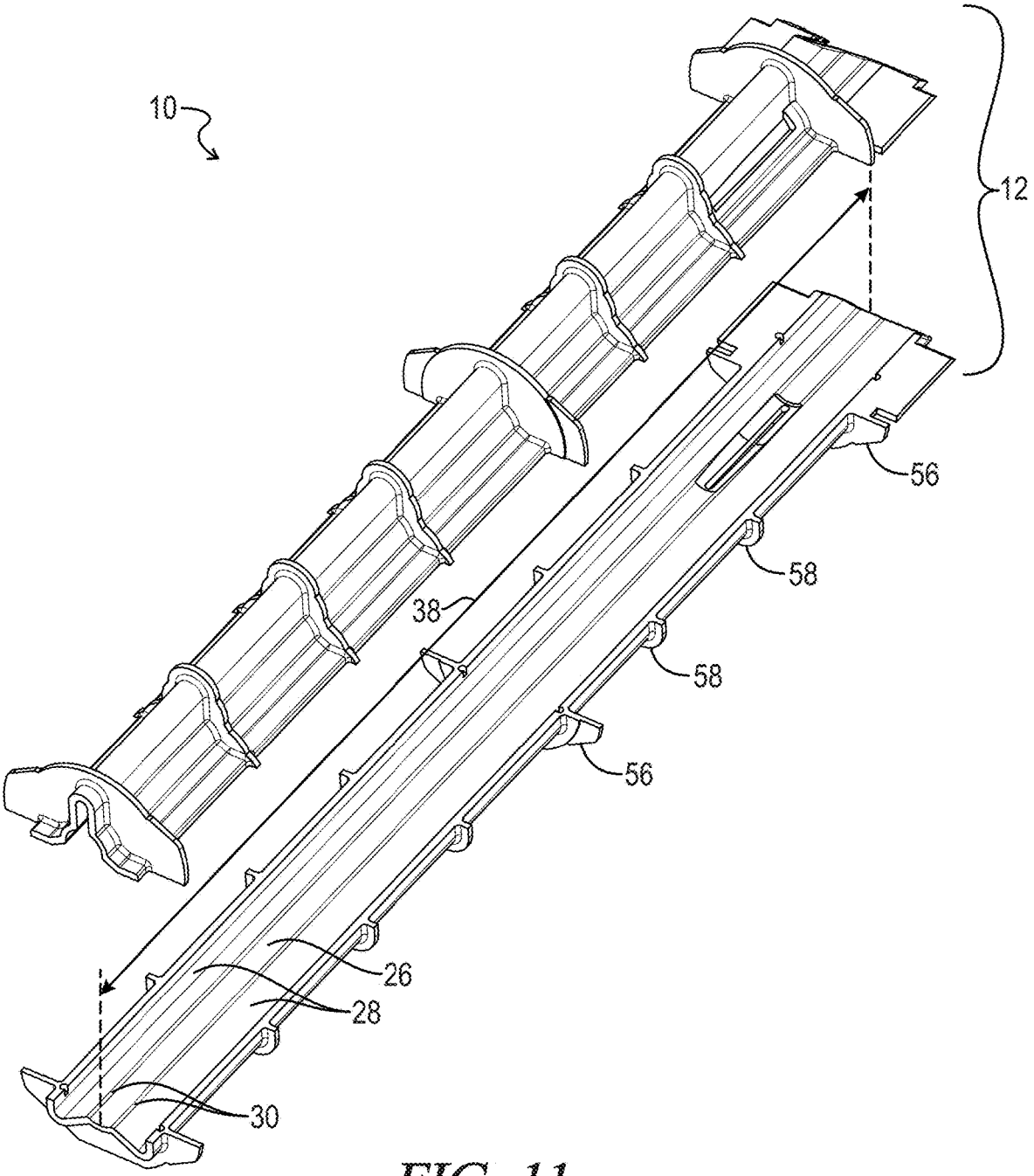
FIG. 11 is an elevated and exploded rear right side perspective view of the arrow stabilizer of claim 7.
Figure 12:
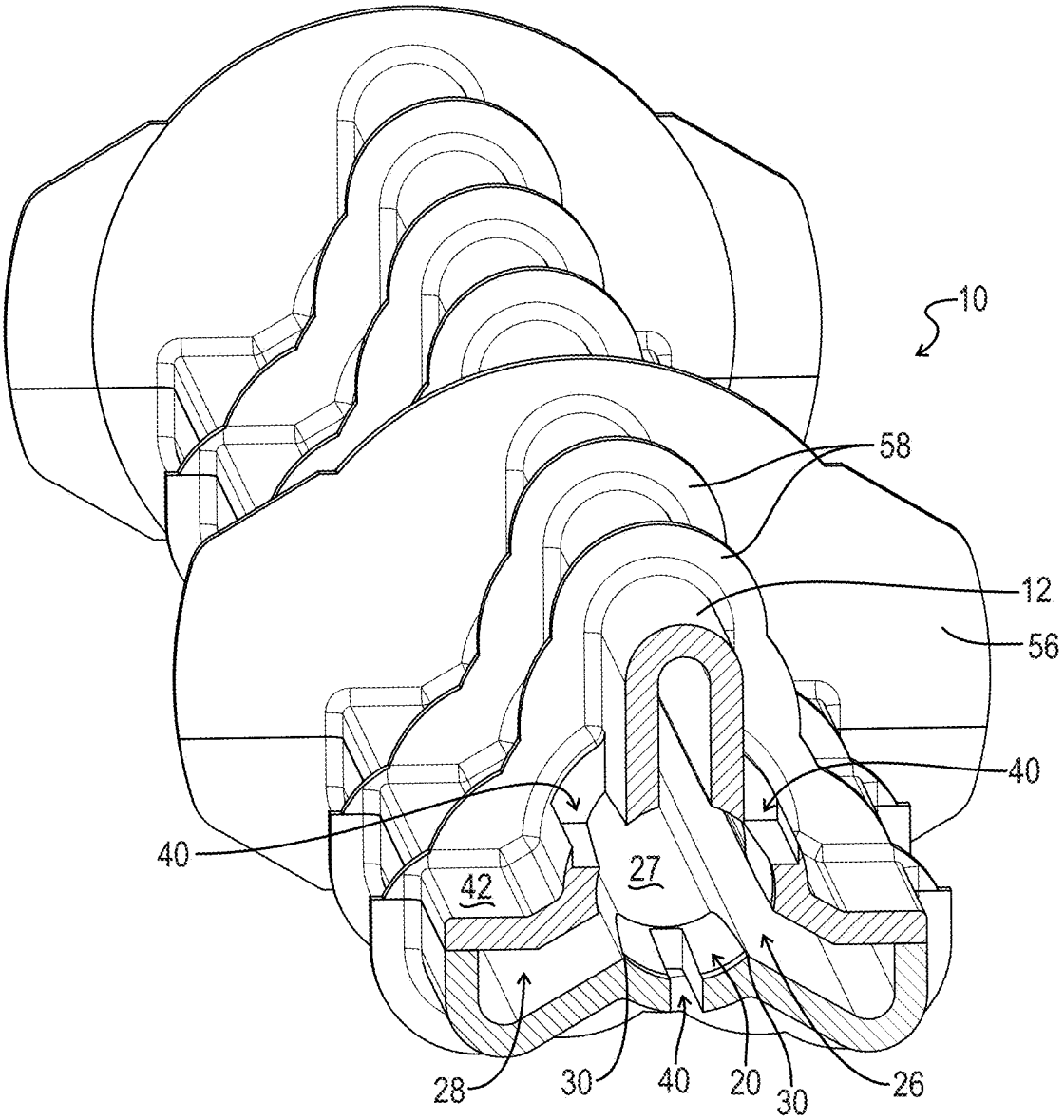
FIG. 12 is perspective sectional view of the arrow stabilizer of FIG. 9 taken along line 12-12.
Figure 13:
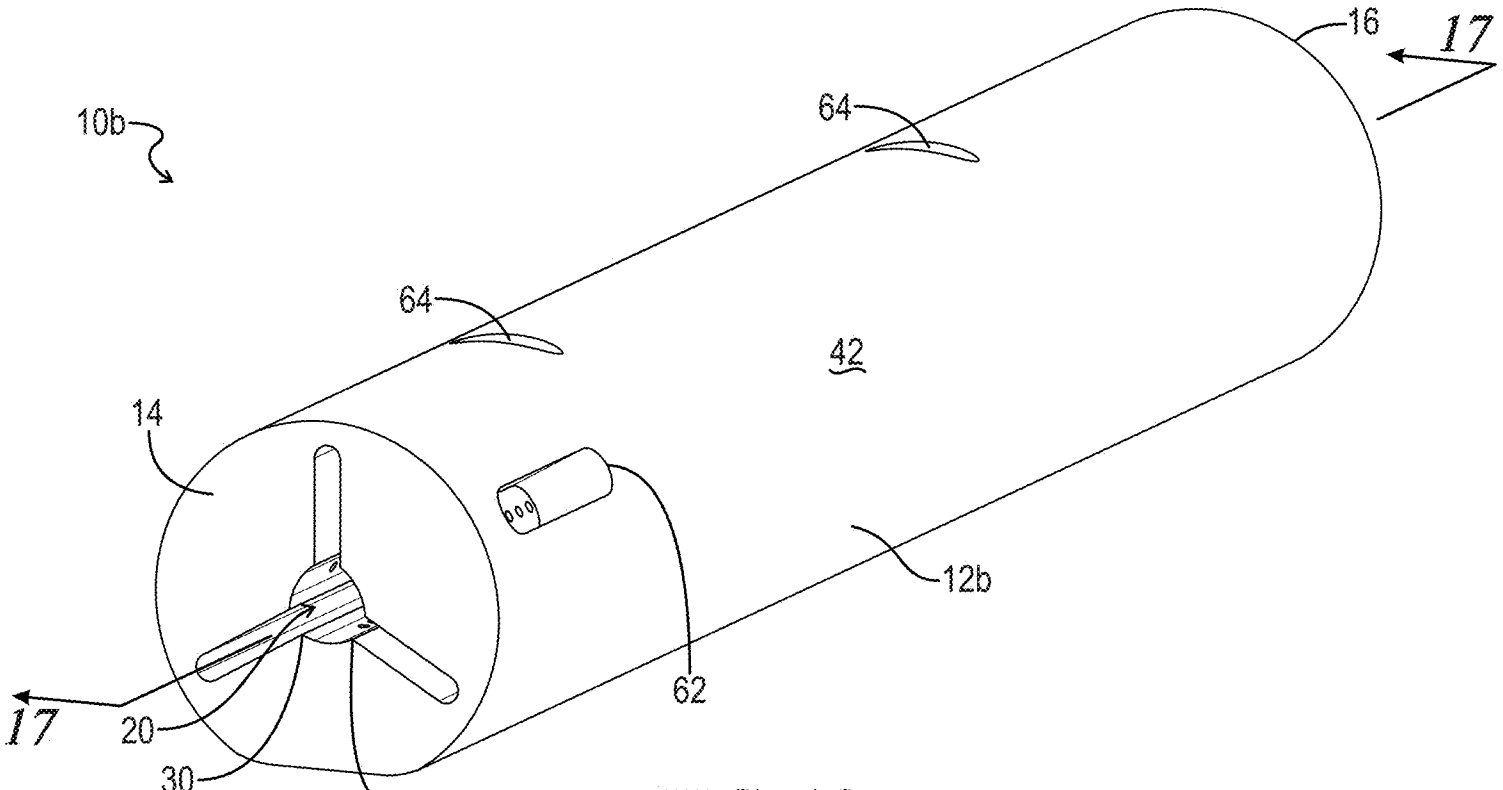
FIG. 13 is an elevated front left side perspective view of another embodiment of an arrow stabilizer for an archery airgun constructed in accordance with the present invention.
Figure 14:
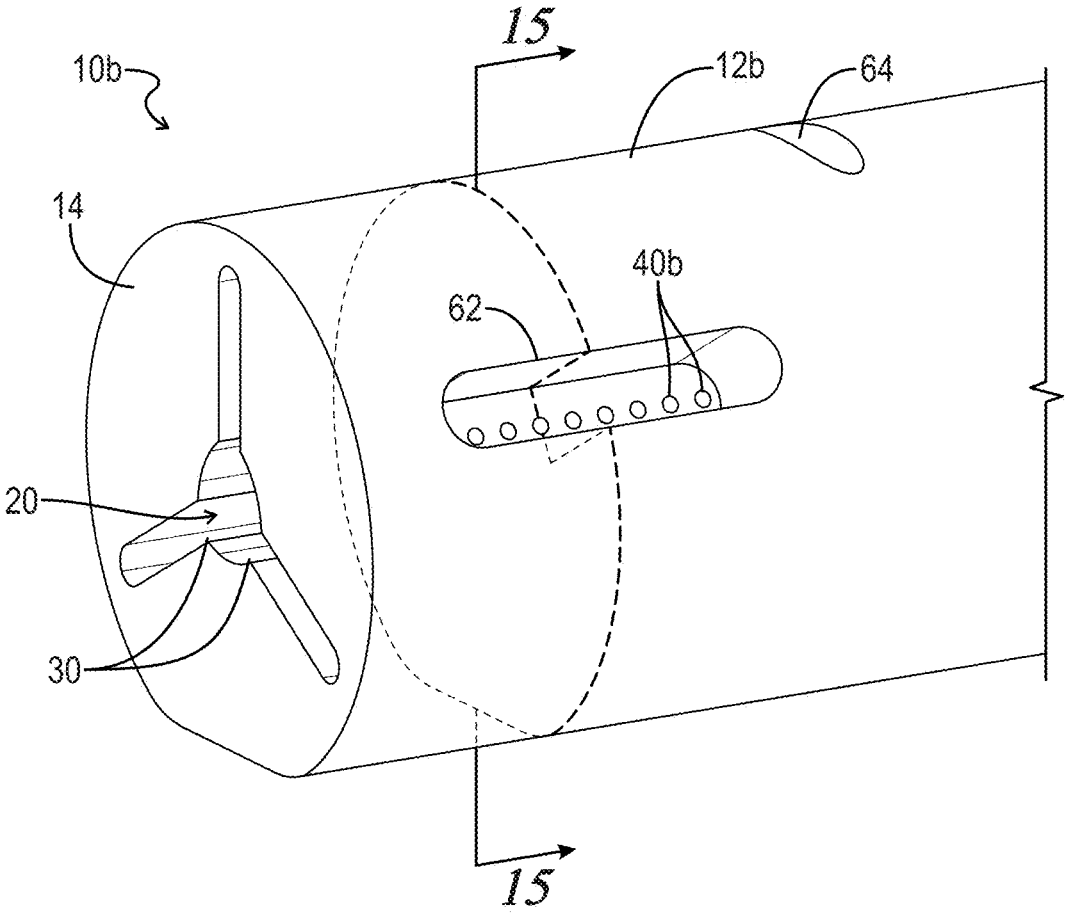
FIG. 14 is a magnified perspective view of the front end of the arrow stabilizer of FIG. 13.
Figure 15:
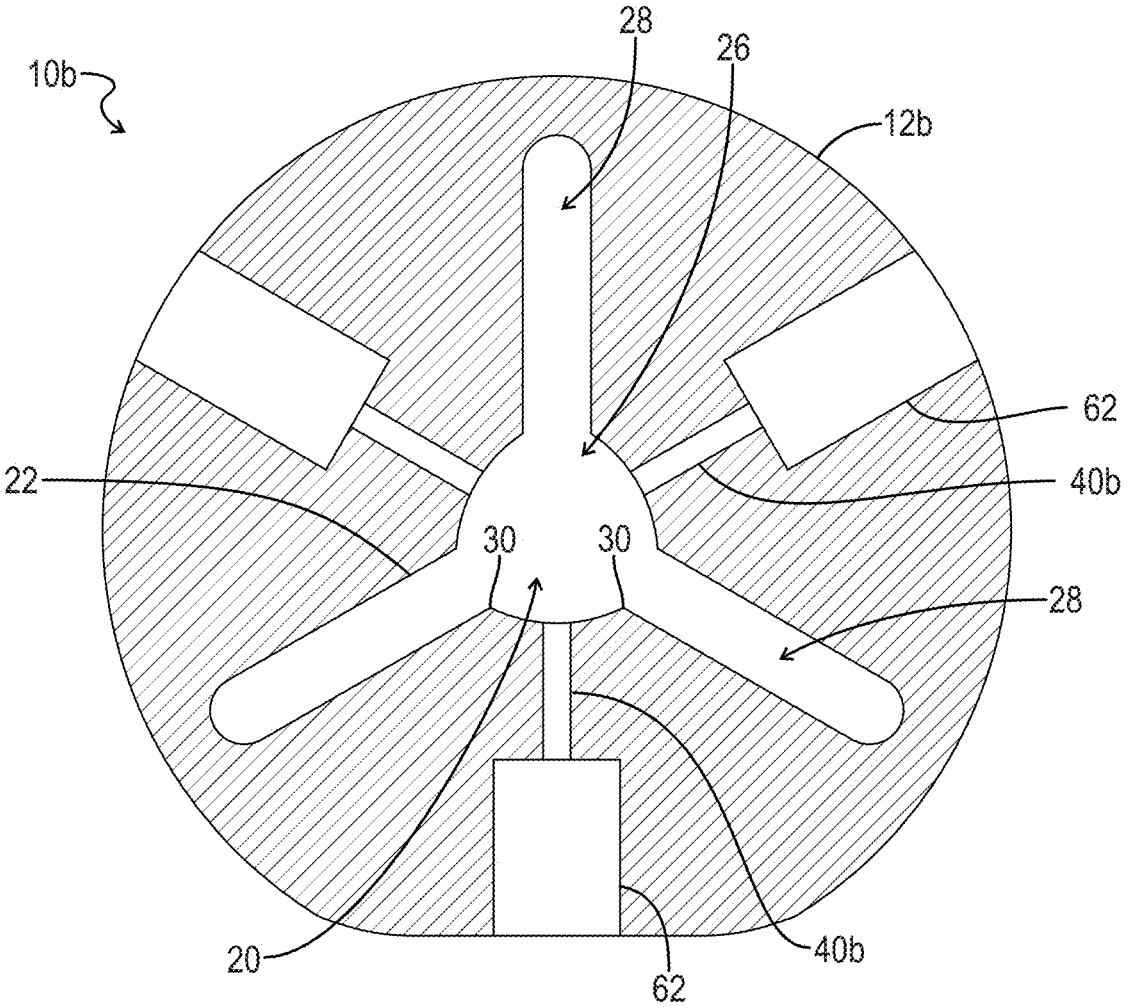
FIG. 15 is a sectional view of the arrow stabilizer of FIG. 14 taken along line 15-15.
Figure 16:
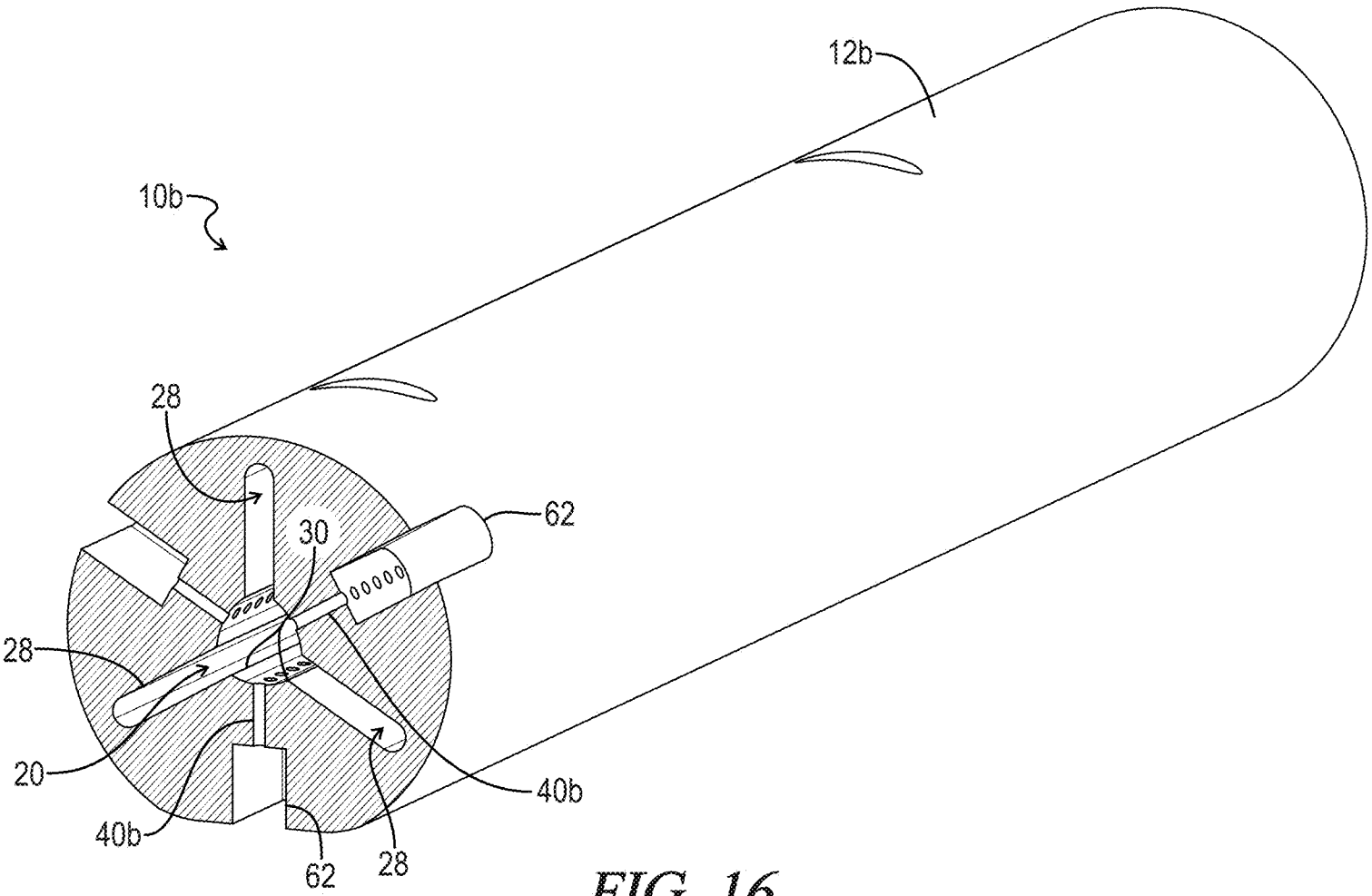
FIG. 16 is an elevated front left side perspective view of the arrow stabilizer of FIG. 15.
Figure 17:
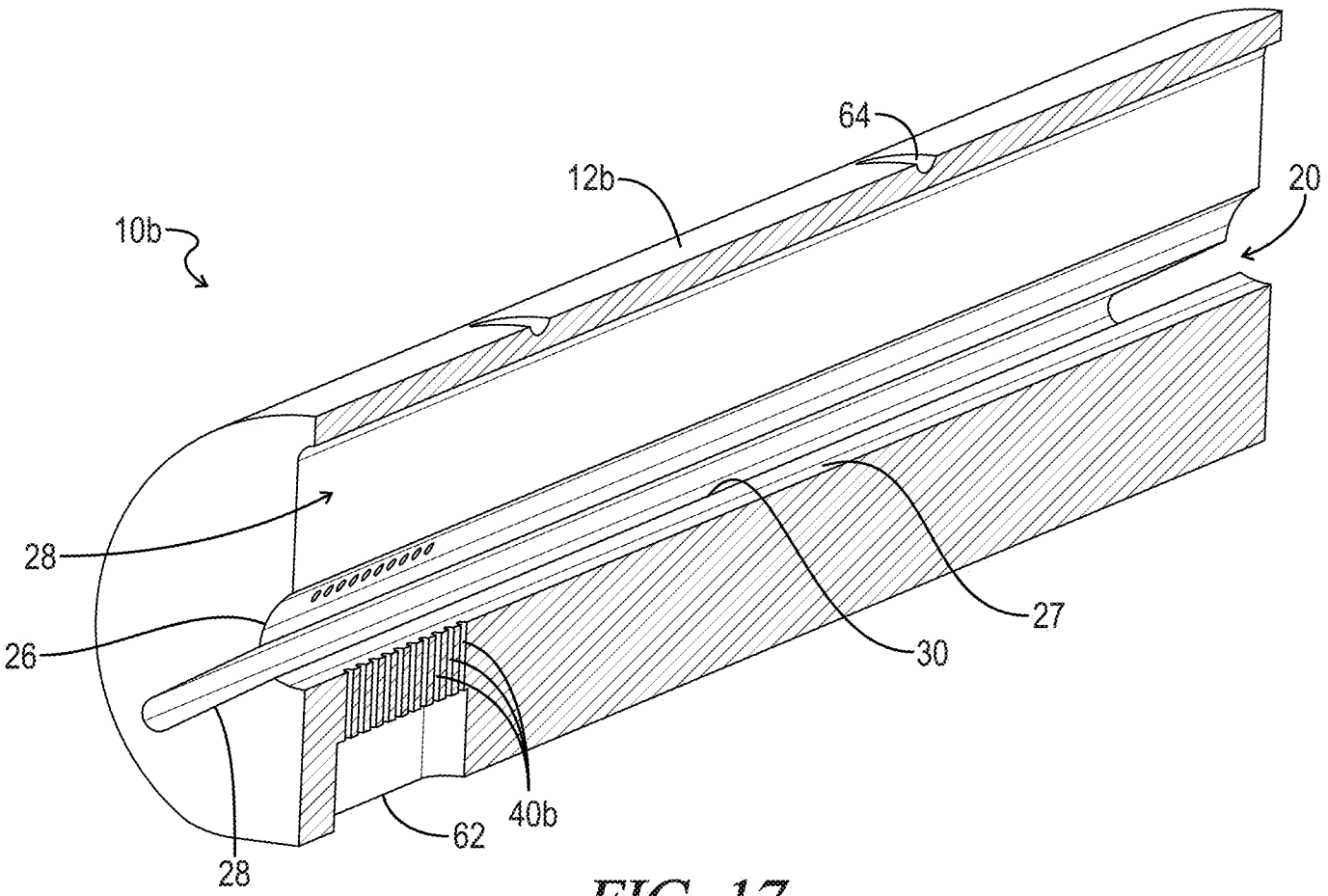
FIG. 17 is a sectional view of the arrow stabilizer of FIG. 13 taken along line 17-17.

In some embodiments, as exemplified in FIG. 6, a sound attenuating material 60 such as a sound absorbing porous foam or fibrous material can be disposed in the interior space 55 around and proximate to the plurality of sound attenuating apertures 40 to further reduce or even eliminate the report emitted by the archery airgun 2 upon firing. In other embodiments, the entire interior space 55 can be filled with the sound attenuating material 60. In specific embodiments, the sound attenuating material 60 can fill the compartment 59 in the interior space 55 defined between two structural baffles or flanges 56. Examples of suitable sound attenuating materials include but are not limited to fiberglass, open-cell polyurethane foam, and natural and synthetic fibers such as wool, cotton, and polyester fibers, among others.

Turning now to FIGS. 13-17, there is depicted another embodiment of an arrow stabilizer **10*b* for an archery airgun constructed in accordance with the present invention. Arrow stabilizer 10*b* is identical to arrow stabilizer 10 in all aspects of form and function except as specifically set forth herein. Specifically, arrow stabilizer 10*b* is a generally cylindrical elongated body 12*b* much like a traditional bull barrel for a firearm, whereas arrow stabilizer 10 is a skeletonized elongated body 12 designed to be as light as possible. Additionally, whereas arrow stabilizer 10 includes sound attenuation apertures 40 in the form of slots, arrow stabilizer 10*b* includes multiple rows of ten cylindrical sound attenuation apertures 40*b* disposed at the bottom of three elongated recesses 62 on the exterior surface 42 of the elongated body 12*b*. Arrow stabilizer 10*b*, like arrow stabilizer 10, is suitable for use as a barrel core for an archery airgun inside a tubular barrel shroud 52 or inside a handguard 8. However, arrow stabilizer 10*b* is provided with channels 64 through which pins (not shown) can be inserted to secure the elongated body 12*b* inside a barrel shroud 52 or handguard 8**.

Arrow stabilizers 10, **10*b* disclosed herein can be formed from any suitably durable material, including but not limited to metallic materials such as aluminum and steel, and in some embodiments, synthetic polymers. It is to be understood that although the arrow stabilizer 10 of FIGS. 1-12 is depicted herein as being formed from two elongated pieces, in other embodiments, the arrow stabilizer 10 can be formed as a single unitary piece, while in still yet other embodiments, the arrow stabilizers 10, 10***b* disclosed herein can be formed from more than two pieces.

Although embodiments of the present invention have been described in detail, it will be understood by those skilled in the art that various modifications can be made therein without departing from the spirit and scope of the invention as set forth in the appended claims.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific apparatus and methods described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention, it is not intended that such references be construed as limitations upon the scope of this invention except as set forth in the following claims.

What is claimed is:

1. An archery airgun, comprising:

a receiver;

a gas propulsion system; and an arrow stabilizer extending from the receiver, the arrow stabilizer including an elongated body defining a non-cylindrical passage extending longitudinally through at least a portion of the body, the passage including a central bore configured to closely receive and support a shaft of a fletched arrow as the arrow travels through the passage when launched by the archery airgun, and a plurality of radial slots extending along the central bore, each radial slot configured to receive a respective fletch of the arrow.

2. The archery airgun of claim 1, wherein the central bore includes a bottom interior surface configured to directly contact the shaft of the arrow as the arrow travels through the passage when launched by the airgun.

3. The archery airgun of claim 1, wherein the plurality of radial slots cooperates with the central bore to form at least two rails upon which the arrow rides as the arrow travels through the passage when launched by the airgun.

4. The archery airgun of claim 3, wherein two radial slots of the plurality are oriented downward when the archery airgun is held in an upright position.

5. The archery airgun of claim 4, wherein the central bore includes a bottom interior surface configured to directly contact the shaft of the arrow as the arrow rides upon the at least two rails while traveling through the passage when launched by the archery airgun.

6. The archery airgun of claim 1, wherein the passage is more than half as long as the arrow.

7. The archery airgun of claim 1, wherein the elongated body includes a plurality of apertures configured to attenuate a sound of the arrow exiting the passage when launched by the archery airgun, the apertures extending through the elongated body from the passage to an external surface of the elongated body.

8. The archery airgun of claim 7, wherein each aperture is in fluid communication with the central bore.

9. The archery airgun of claim 8, wherein:

the elongated body includes a front end through which the arrow exits the passage when launched by the archery airgun, and a rear end opposite the front end; and the plurality of apertures is proximate the front end.

10. The archery airgun of claim 7, further comprising:

a shroud in which the elongated body is received, the shroud defining an interior space around at least a portion of the elongated body such that a gas emitted by the archery airgun during launch of the arrow vents through the plurality of apertures into the interior space as the arrow exits the passage.

11. The archery airgun of claim 10, further comprising a sound attenuating material received in the interior space.

12. The archery airgun of claim 10, further comprising a plurality of baffles in the interior space configured to slow the gas in the interior space.

13. A barrel for an archery airgun, comprising:

an elongated body having a front end, a rear end, and a passage extending longitudinally through at least a portion of the elongated body from the front end toward the rear end, the passage including a central bore configured to closely receive and hold a shaft of a fletched arrow substantially stable as the arrow travels through the passage when launched by the archery airgun, and a plurality of radial slots extending along the central bore, each radial slot configured to receive a respective fletch of the arrow as the arrow travels through the passage when launched by the archery airgun;

a tubular shroud defining an interior space in which the elongated body is received, the tubular shroud extending from the front end to the rear end of the elongated body;

a plurality of apertures fluidly communicating the central bore with the interior space such that a gas emitted by the archery airgun during launch of the arrow vents through the plurality of apertures into the interior space as the arrow exits the passage; and a sound absorbing material received in the interior space around the plurality of apertures.

14. The barrel of claim 13, further comprising a plurality of flanges on an exterior surface of the elongated body configured to space the elongated body from the shroud and compartmentalize the interior space.

15. An archery airgun comprising the barrel of claim 13.

16. An archery airgun, comprising:

a receiver;

a gas propulsion system; and an elongated body extending from the receiver, the elongated body defining a non-cylindrical passage including:

a central bore configured to closely receive a uniformly cylindrical or tubular shaft of a fletched arrow and hold the shaft of the arrow substantially stable as the arrow travels through the passage when launched by the archery airgun, and a plurality of radial slots extending along the central bore, each radial slot configured to receive a respective fletch of the arrow;

wherein two radial slots of the plurality extend from the central bore below a longitudinal axis of the elongated body when the archery airgun is held in an upright position such that the two radial slots cooperate with the central bore to form rails upon which the arrow rides as the arrow travels through the passage when launched by the archery airgun.

* * * * *